US010633774B2

(12) United States Patent
Brown et al.

(10) Patent No.: US 10,633,774 B2
(45) Date of Patent: Apr. 28, 2020

(54) HYBRID NON-WOVEN WEB AND AN APPARATUS AND METHOD FOR FORMING SAID WEB

(71) Applicant: Biax-Fiberfilm Corporation, Greenville, WI (US)

(72) Inventors: Douglas B. Brown, Fremont, WI (US); Jeffrey D. Stark, Neenah, WI (US); Mohammad A. Hassan, Appleton, WI (US)

(73) Assignee: Biax-Fiberfilm Corporation, Greenville, WI (US)

( * ) Notice: Subject to any disclaimer, the term of this patent is extended or adjusted under 35 U.S.C. 154(b) by 970 days.

(21) Appl. No.: 14/711,024

(22) Filed: May 13, 2015

(65) Prior Publication Data

US 2015/0322601 A1 Nov. 12, 2015

Related U.S. Application Data

(63) Continuation-in-part of application No. 14/271,638, filed on May 7, 2014, now Pat. No. 9,303,334, and a (Continued)

(51) Int. Cl.
*D04H 1/56* (2006.01)
*D04H 1/4382* (2012.01)

(Continued)

(52) U.S. Cl.
CPC ..... *D04H 1/4382* (2013.01); *D04H 1/413* (2013.01); *D04H 1/56* (2013.01); *D04H 1/724* (2013.01);

(Continued)

(58) Field of Classification Search
CPC ... B32B 5/022; B32B 2307/54; B29C 64/106; B29C 47/0014; B29C 47/0004;

(Continued)

(56) References Cited

U.S. PATENT DOCUMENTS 3,704,198 A 11/1972 Prentice
4,100,324 A 7/1978 Anderson et al.

(Continued)

FOREIGN PATENT DOCUMENTS

EP 0341875 11/1989
EP 1101854 5/2001

OTHER PUBLICATIONS

"Denier to Decitex Converter" (http://dhard.ucp-is.com/docs/specs/Cords/Denier2Dtex.converter/denier-to-decitex.html) (converter). (Year: 2018).*

(Continued)

*Primary Examiner* — Vincent Tatesure

(74) *Attorney, Agent, or Firm* — Boyle Fredrickson S.C.

(57) ABSTRACT

A hybrid non-woven web is disclosed which is a matrix of a stream of fibers of a first material joined to streams of first and second spun-blown fibers. Each of the first and second spun-blown fibers are formed from a thermoplastic composition that contains at least one polymer having a melt flow rate of from between about 5 grams/10 minutes to about 6,000 grams/10 minutes at 230° C. Each of the first and second spun-blown fibers also have an average diameter of between about 1 microns to 10 microns and a standard deviation of from between about 0.9 microns to about 5 microns. In addition, the hybrid non-woven web has a tensile strength of at least about 5 gf/gsm/cm width, measured in a machine direction. An apparatus and a method of forming the hybrid non-woven web are also disclosed.

9 Claims, 5 Drawing Sheets

Related U.S. Application Data continuation-in-part of application No. 14/271,655, filed on May 7, 2014, now Pat. No. 9,309,612, and a continuation-in-part of application No. 14/271,675, filed on May 7, 2014, now abandoned.

(51) Int. Cl.
*D04H 1/724* (2012.01)
*D04H 1/736* (2012.01)
*D04H 1/413* (2012.01)

(52) U.S. Cl.
CPC ..... *D04H 1/736* (2013.01); *D10B 2321/022* (2013.01); *D10B 2331/04* (2013.01); *Y10T 442/609* (2015.04)

(58) Field of Classification Search
CPC ..... B29C 45/0001; B29K 2105/0094; Y10T 428/249921; Y10T 428/298; Y10T 442/60; Y10T 442/608; Y10T 442/681; Y10T 428/26; Y10T 428/2927; D04H 1/4382; D04H 1/413; D04H 1/56; D04H 1/724; D04H 1/736
USPC ..... 442/327, 274, 430, 411, 415
See application file for complete search history.

(56) References Cited

U.S. PATENT DOCUMENTS 4,923,454 A 5/1990 Seymour et al.
5,350,624 A 9/1994 Georger et al.
5,476,616 A 12/1995 Schwarz
5,508,102 A 4/1996 Georger et al.
6,013,223 A 1/2000 Schwarz
6,133,166 A * 10/2000 Nissing ..... A61K 8/0208 442/61
6,315,114 B1 11/2001 Keck et al.
6,471,910 B1 10/2002 Haggard et al.
7,018,188 B2 3/2006 James et al.
8,017,534 B2 9/2011 Harvey et al.
8,122,570 B2 2/2012 Jezzi
8,303,888 B2 11/2012 Brown et al.
2005/0056956 A1 3/2005 Zhao et al.
2005/0079781 A1* 4/2005 Tsujimoto ..... D04H 3/12 442/59
2005/0241095 A1* 11/2005 Olson ..... A47L 13/16 15/228
2009/0025894 A1* 1/2009 Barnholtz ..... D21H 27/002 162/141
2009/0221206 A1 9/2009 Gerking
2009/0233049 A1 9/2009 Jackson et al.
2009/0233073 A1 9/2009 Bornemann et al.
2010/0130084 A1* 5/2010 Matsubara ..... A47L 13/16 442/356
2010/0228214 A1* 9/2010 Bornemann ..... B32B 5/24 604/372
2011/0045261 A1 2/2011 Sellars
2011/0076907 A1 3/2011 Glew et al.
2012/0066855 A1 3/2012 Schmidt et al.
2012/0171919 A1* 7/2012 Jackson ..... A47L 13/16 442/400
2012/0208422 A1 8/2012 Koori et al.
2013/0165007 A1 6/2013 Pourdeyhimi et al.

OTHER PUBLICATIONS

Knovel Unit Converter (https://app.knovel.com/uc/#val=1&in=N&out=gf&dig=4&ntn=dec) (Knovel). (Year: 2018).*

* cited by examiner

HYBRID NON-WOVEN WEB AND AN APPARATUS AND METHOD FOR FORMING SAID WEB

RELATED U.S. APPLICATION DATA

This application is a Continuation-In-Part of U.S. Ser. Nos. 14/271,638; 14/271,655 and 14/271,675, all filed on May 7, 2014 and assigned to Biax-Fiberfilm Corporation.

FIELD OF THE INVENTION

This invention relates to a hybrid non-woven web and an apparatus and method for forming the web.

BACKGROUND OF THE INVENTION

Meltblown fibers can be manufactured with very fine diameters, in the range of 1-10 microns, which is very advantageous in forming various kinds of non-woven fabrics. However, meltblown fibers are relatively weak in strength. To the contrary, spunbond fibers can be manufactured to be very strong but have a much larger diameter, in the range of 15-50 microns. Fabrics formed from spunbond are less opaque and tend to exhibit a rough surface since the fiber diameters are quite large. In addition, spinning of thermoplastic resins through a multi-row spinnerette, according to the teachings in U.S. Pat. No. 5,476,616 issued to Schwarz, is quite challenging because of the fast solidification of the outer rows and/or columns of filaments. Due to this fast solidification in the outer rows and/or columns, the filaments tend to be larger and/or form rope defects with adjacent inner rows and/or columns of filaments. U.S. Ser. Nos. 14/271,638; 14/271,655 and 14/271,675 all filed on the same day by Brown et al. and assigned to Biax-Fiberfilm Corporation, teaches forming a non-woven web and an apparatus and method for forming the web from spun-blown® fibers with minimal roping.

Up until now, no one has been able to successfully spin thermoplastic resins of high molecular weight and high viscosity through fine capillaries and attenuate them with high speed air retained at a temperature ranging from between about 0° C. to about 250° C., colder or hotter, than polymer melt temperatures. By being able to do this, one can obtain spun-blown® fibers which have a diameter similar to the diameters of meltblown fibers but which exhibit strength properties approaching those of spunbond fibers. Because the spun-blown® fibers are fine and strong, a smaller quantity of them can be comingled with a first material, such as staple/pulp fibers, to form an inexpensive, hybrid non-woven web.

Now, a hybrid non-woven web has been invented along with an apparatus and method for forming such a web. The hybrid non-woven web includes a matrix of a first material and first and second spun-blown® fibers. Each of the first and second spun-blown® fibers are formed from a thermoplastic composition that contains at least one polymer having a melt flow rate of from between about 5 grams/10 minutes to about 6,000 grams/10 minutes at 230° C., an average diameter of between about 1 microns to 10 microns, and a standard deviation of from between about 0.9 microns to about 5 microns. The hybrid non-woven web also has a tensile strength of at least about 5 gf/gsm/cm width, measured in a machine direction. Because the first and second spun-blown® fibers are of high strength, a smaller quantity of them are needed to fabricate the hybrid non-woven web.

In addition, a new class of hybrid non-woven structures can be produced which will exhibit excellent tensile and absorption properties.

SUMMARY OF THE INVENTION

Briefly, this invention relates to a hybrid non-woven web and an apparatus and method for forming the web. The hybrid non-woven web includes a matrix of a first material and first and second spun-blown® fibers. Each of the first and second spun-blown® fibers are formed from a thermoplastic composition that contains at least one polymer having a melt flow rate of from between about 5 grams/10 minutes to about 6,000 grams/10 minutes at 230° C., an average diameter of between about 1 microns to 10 microns, and a standard deviation of from between about 0.9 microns to about 5 microns. The hybrid non-woven web also has a tensile strength of at least about 5 gf/gsm/cm width, measured in a machine direction.

An apparatus for forming a hybrid non-woven web is also taught. The apparatus includes a fiberizer for forming a plurality of fibers of a first material. The apparatus also includes first and second extruders. A first die block is connected to the first extruder. The first die block is capable of forming a plurality of first spun-blown® fibers. A second die block is connected to the second extruder. The second extruder is capable of forming a plurality of second spun-blown® fibers. The first and second die blocks are angled relative to the discharge nozzle or duct to cause the first and second spun-blown® fibers to merge and be comingled with the fibers of the first material and form a hybrid non-woven web. A movable forming wire is positioned to receive and convey the hybrid non-woven web in a desired direction. Lastly, the apparatus includes a wind-up spindle for collecting the hybrid non-woven web which exits the forming wire.

The method for forming the hybrid non-woven web includes the steps of merging a stream of fibers of a first material between first and second streams of first and second spun-blown® fibers to form a matrix. Each of the first and second spun-blown® fibers are formed from a thermoplastic composition that contains at least one polymer having a melt flow rate of from between about 5 grams/10 minutes to about 6,000 grams/10 minutes at 230° C., an average diameter of between about 1 microns to 10 microns, and a standard deviation of from between about 0.9 microns to about 5 microns. The hybrid non-woven web also has a tensile strength of at least about 5 gf/gsm/cm width, measured in a machine direction. The method further includes collecting the matrix of fibers on a forming wire to form a hybrid non-woven web.

The general object of this invention is to provide a hybrid non-woven web. A more specific object of this invention is to provide a hybrid non-woven web which includes a matrix of fibers of a first material and first and second spun-blown® fibers.

Another object of this invention is to provide a hybrid non-woven web which includes a matrix of fibers of a first material and first and second spun-blown® fibers wherein the first spun-blown® fibers are different from the second spun-blown® fibers.

A further object of this invention is to provide a hybrid non-woven web which includes a matrix of fibers of a first material and first and second spun-blown® fibers wherein each of the spun-blown® fibers are formed from a thermoplastic composition that contains at least one polymer having a melt flow rate of from between about 5 grams/10 minutes to about 6,000 grams/10 minutes at 230° C., an average diameter of between about 1 microns to 10 microns, and a standard deviation of from between about 0.9 microns to about 5 microns.

Still another object of this invention is to provide a hybrid non-woven web having a tensile strength of at least about 5 gf/gsm/cm width, measured in a machine direction, and an apparatus and a method for forming the hybrid non-woven web.

Still further, an object of this invention is to provide a hybrid non-woven web that can be used in various products including, but not limited to: baby wipes, household and industrial wipes, industrial absorbents, absorbent cores for diapers, sanitary napkins and undergarments, thermal insulation, acoustical insulation, bedding, upholstery, filtration, foam replacement materials, seating cushions, etc.

Other objects and advantages of the present invention will become more apparent to those skilled in the art in view of the following description and the accompanying drawings.

DEFINITIONS

Figure 1:
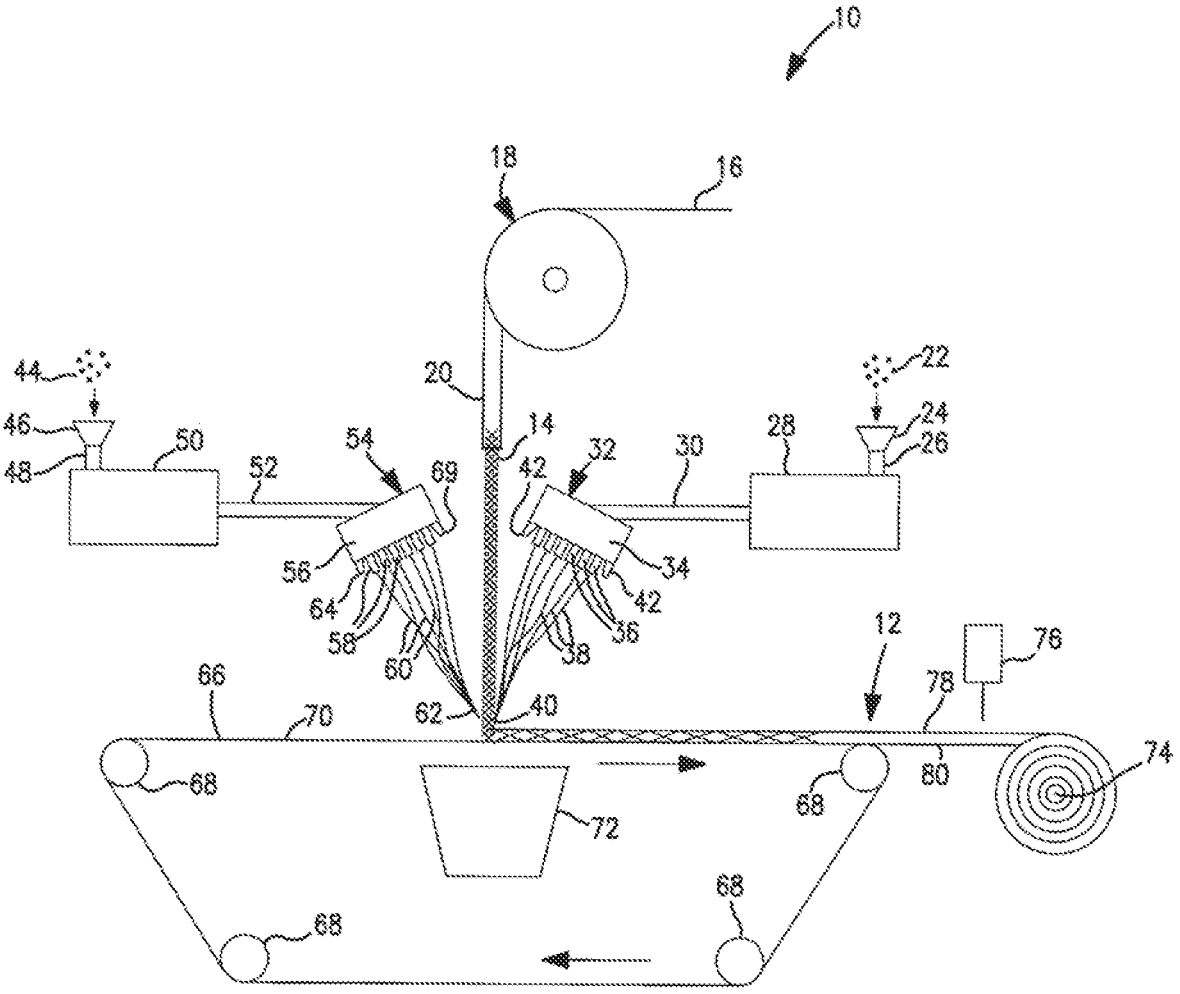
FIG. 1 is a schematic of a method for forming a hybrid non-woven web.

Non-woven is defined as a sheet, mat, web or batt of natural and/or man-made fibers or filaments (excluding paper) that have not been converted into yarns, and that are bonded to each other by mechanical, hydro-mechanical, thermal or chemical means.

Spunmelt is a process where fibers are spun from molten polymer through a plurality of holes in a die head connected to one or more extruders. The spunmelt process may include meltblown, spunbond and the present inventive process, which we call spun-blown).

Meltblown is a process for producing very fine fibers having a diameter of less than about 10 microns, where a plurality of molten polymer streams are attenuated using a hot, high speed gas stream once the filaments emerge from the nozzles. The attenuated fibers are then collected on a flat belt or dual drum collector. A typical meltblown die has around 35 holes per inch and a single row spinnerette. The typical meltblown die uses two inclined air jets for attenuating the filaments.

Spunbond is a process for producing strong fibrous non-woven webs directly from thermoplastics polymers by attenuating the spun filaments using cold, high speed air while quenching the fibers near the spinnerette face. Individual fibers are then laid down randomly on a collection belt and conveyed to a bonder to give the web added strength and integrity. Fiber size is usually below 250 μm and the average fiber size is in the range of from between about 10 microns to about 50 microns. The fibers are very strong compared to meltblown fibers because of the molecular chain alignment that is achieved during the attenuation of the crystallized (solidified) filaments. A typical spunbond die has multiple rows of polymer holes and the polymer melt flow rate is usually below about 500 grams/10 minutes.

Coform is a technique generally made by a process in which conventional meltblown fibers are comingled with staple/pulp fibers to produce absorbent materials. The meltblown fibers are mainly used to hold the short pulp fibers together. Coform is disclosed in a number of U.S. Patents, such as U.S. Pat. No. 4,100,324 issued to Anderson et al; U.S. Pat. No. 4,923,454 issued to Seymour et al.; and U.S. Pat. No. 8,017,534 issued to Harvey et al., as well as U.S. Publication No. 2009/0233049 to Jackson et al. Since the conventional meltblown fibers are weak, non-woven manufacturers are forced to use more than about 25% thermoplastic fibers, such as polypropylene meltblown fibers to add integrity to the finished web. Because the thermoplastic fibers are more expensive than the pulp fibers, the higher the amount of thermoplastic fibers in the web, the higher is the cost of the web.

spun-blown® is a registered trademark of Biax FiberFilm Corp. having an office at N1001 Tower View Drive, Greenville, Wis. 54942-8635. Spun-blown® is a hybrid process between meltblown and spunbond. It is a process that bridges the gap between these two processes. The spun-blown® process uses multi-row spinnerettes similar to spunbond except the filaments are cooled and attenuated at the nozzle discharge. Additional filament attenuation may be achieved using aspirators to obtain strong fibers having smaller diameters, similar to the diameters of meltblown fibers. The spun-blown® process is very flexible and can accommodate both meltblown and spunbond resins which may have a melt flow rate of from between about 4 to about 2,500 grams/10 minutes at 230° C., 2.16 kg, (ASTM D 1238).

Bi-form® is a registered trademark of Biax FiberFilm Corp. having an office at N1001 Tower View Drive, Greenville, Wis. 54942-86350. Bi-form® is a technique generally made by a process in which spun-blown® fibers are comingled with the fibers of a first material, such as staple/pulp fibers, to produce hybrid non-woven webs. The spun-blown® fibers are mainly used to bond or encapsulate the fibers of the first material. This technique is disclosed in U.S. Ser. Nos. 14/271,675; 14/271,638; 14/271,655; 14/167,366; 14/167,431 and 14/167,488 all assigned to Biax-FiberFilm Corporation. Since the conventional meltblown fibers are relatively weak, one was required to use more than 25% of the meltblown fibers with the fibers of the first material in order to obtain a non-woven web having adequate integrity. In addition to this, the conventional meltblown process cannot spin high molecular weight resins and more viscous polymer resins at a reasonable throughput.

DETAILED DESCRIPTION OF THE INVENTION

Referring to FIG. 1, a method 10 is shown for producing a hybrid non-woven web 12. The hybrid non-woven web 12 can have a high loft. The hybrid non-woven web 12 is a matrix formed by introducing a stream of fibers of a first material 14 between two polymer streams. By "matrix" it is meant a situation or surrounding substance within which something else originates, develops or is contained. The first material 14 can be absorbent fibers or non-absorbent fibers. The first material 14 can be in the form of fibers, particles, gels, etc. Desirably, the first material 14 includes staple/pulp fibers. The first material 14 can include fibers formed by a variety of pulping processes, such a kraft pulp, sulfite pulp, thermo-mechanical pulp, etc. The pulp fibers may include softwood fibers having an average fiber length of greater than 1 millimeter (mm) and particularly from about 2 mm to 5 mm based on a length-weighted average. Such softwood fibers can include, but are not limited to: northern softwood, southern softwood, redwood, red cedar, hemlock, pine (e.g. southern pines), spruce (e.g. black spruce), combinations thereof, and so forth. Exemplary commercially available pulp fibers suitable in the present invention include those available from Weyerhaeuser Co. of Federal Way, Washington under the designation "Weyco CF-405". Hardwood fibers, such as *eucalyptus*, maple, birch, aspen, and so forth, can also be used. In certain instances, *eucalyptus* fibers may be particularly desired to increase the softness of the hybrid non-woven web. *Eucalyptus* fibers can also enhance the brightness, increase the opacity, and change the pore structure of the hybrid non-woven web to increase its wicking ability. Moreover, if desired, secondary fibers obtained from recycled materials may be used, such as fiber pulp from sources such as, for example, newsprint, reclaimed paperboard and office waste. Further, other natural fibers can also be used in the present invention, such as abaca, sabai grass, milkweed floss, pineapple leaf, and so forth. In addition, in some instances, synthetic fibers can also be utilized.

Besides or in conjunction with pulp fibers, the first material 14 may also include a superabsorbent that is in the form of fibers, particles, gels, etc. Generally speaking, superabsorbents are water-swellable materials capable of absorbing at least about 20 times their weight and, in some cases, at least about 30 times their weight, in an aqueous solution containing 0.9 weight percent sodium chloride. The superabsorbent may be formed from natural, synthetic and modified natural polymers and materials. Examples of synthetic superabsorbent polymers include the alkali metal and ammonium salts of poly(acrylic acid) and poly(methacrylic acid), poly(acrylamides), poly(vinyl ethers), maleic anhydride copolymers with ethers and alpha-olefins, poly(vinyl pyrrolidone), poly(vinylmorpholinone), poly(vinyl alcohol), and mixtures and copolymers thereof. Further superabsorbents include natural and modified natural polymers, such as hydrolyzed acrylonitrile-grafted starch, acrylic acid grafted starch, methyl cellulose, chitosan, carboxymethyl cellulose, hydroxypropyl cellulose, and the natural gums, such as alginates, xanthan gum, locust bean gum and so forth. Mixtures of natural and wholly or partially synthetic superabsorbent polymers may also be useful in the present invention. Particularly suitable superabsorbent polymers are HYSORB 8800AD, available from BASF of Charlotte, N.C., and FAVOR SXM 9300, available from Degrussa Superabsorber of Greensboro, N.C.

Still referring to FIG. 1, the first material 14 can enter the process or method 10 in the form of sheets or mats 16 which are fed into a fiberizer 18. The fiberizer 18 can vary in size, shape and design. The fiberizer 18 functions to break the sheets or mats 18 into a plurality of individual fibers 14. The fiberizer 18 can vary. For example, the fiberizer 18 can be a hammer mill, a picker roll, or some other mechanism known to those skilled in the art. The temperature and relative humidity within the fiberizer 18 can be carefully controlled. For example, when a hammer mill is utilized, the inside chamber of the hammer mill should be maintained at a temperature of about 24° C. and at a relative humidity above 60%. The fiberizer 18 contains a discharge nozzle 20 that delivers the fiberized pulp fibers between two spun-blown streams, 42 and 62. The discharge nozzle 20 can be designed according to the teachings of U.S. Pat. No. 8,122,570 issued to Jezzi on Feb. 28, 2012 in order to deliver uniform pulp fibers across the width of the machine. This patent is incorporated by reference and made a part hereof.

The throughput of the first material 14 can be controlled by the input feeding speed of the sheets or mats 16, as well as by the gas (air) blower speed of a blower connected to the fiberizer 18 or the nozzle 20. Because of the high strength of the first and second spun-blown® fibers, 40 and 62 respectively, which will be discussed below, the final concentration of the fibers of the first material 14 in the hybrid, non-woven web 12 can range from between about 40% to about 95%. Desirably, the final concentration of the fibers of the first material 14 in the hybrid, non-woven web 12 can range from between about 45% to about 90%. More desirably, the final concentration of the fibers of the first material 14 in the hybrid, non-woven web 12 can range from between about 50% to about 85%. Even more desirably, the final concentration of the fibers of the first material 14 in the hybrid, non-woven web 12 can range from between about 55% to about 80%.

The individual fibers 14 are conveyed downward through the nozzle 20. A gas, such as air, is supplied to the upper end of the nozzle 20 to serve as a medium for conveying the fibers of the first material 14 through the nozzle 20.

The gas (air) may be supplied by any conventional arrangement such as, for example, an air blower (not shown).

It is envisioned that other materials, such as an additive, may be added to or be entrained in the gas (air) stream to treat the fibers of the first material 14, if desired. The individual fibers of the first material 14 are typically conveyed through the nozzle 20 at about the velocity at which the fibers of the first material 14 leave the fiberizer 18. In other words, the fibers of the first material 14 that enter the nozzle 20 generally maintain their velocity in both magnitude and direction. U.S. Pat. No. 4,100,324, issued to Anderson et al. teaches such an arrangement and is incorporated by reference and made a part hereof.

Still referring to FIG. 1, a first polymer resin 22, in the form of small solid pellets, granules or powder, is placed into a hopper 24 and is then routed through a conduit 26 to an extruder 28. In the extruder 28, the first polymer resin 22 is heated to an elevated temperature. The temperature will vary depending on the composition and melting point of a particular polymer. Usually, the first polymer resin 22 is heated to a temperature at or above its melt temperature. The molten, first polymer resin 22 is transformed into a molten material (polymer) which is then routed through a conduit 30 to a die block 32 having a Spinnerette 34 secured thereto. The Spinnerette 34 contains a plurality of nozzles 36 through which the molten material is extruded into filaments 38. The filaments 38 are contacted by gas (air) jets (not shown) which draw the filaments 38 into first spun-blown® fibers 40. Each of the filaments 40 has an average diameter of less than about 10 microns. Desirably, each of the filaments 40 has an average diameter ranging from between about 1 micron to about 10 microns. More desirably, each of the filaments 40 has an average diameter ranging from between about 1 micron to about 9 microns.

The Spinnerette 34 includes a pair of cover strips 42, 42 which function to shelter the plurality of nozzles 36 from the entrained air in the room that may be drawn in from the sides and which could have a cooling effect on the extruded filaments 38, 38.

The first polymer resin 22 can vary in composition. The first polymer resin 22 can be a thermoplastic. The first polymer resin 22 can be selected from the group consisting of: polyolefins, polyesters, polyethylene terephthalates, polybutylene terephthalates, polycyclohexylene dimethylene terephthalates, polytrimethylene terephthalates, polymethyl methacrylates, polyamides, nylons, polyacrylics, polystyrenes, polyvinyls, polytetrafluoroethylenes, ultrahigh molecular weight polyethylenes, very high molecular weight polyethylenes, high molecular weight polyethylenes, polyether ether ketones, non-fibrous plasticized celluloses, polyethylenes, polypropylenes, polybutylenes, polymethylpentenes, low-density polyethylenes, linear low-density polyethylenes, high-density polyethylenes, polystyrenes, acrylonitrile-butadiene-styrenes, styrene-acrylonitriles, styrene tri-block and styrene tetra block copolymers, styrene-butadienes, styrene-maleic anhydrides, ethylene vinyl acetates, ethylene vinyl alcohols, polyvinyl chlorides, cellulose acetates, cellulose acetate butyrates, plasticized cellulosics, cellulose propionates, ethyl cellulose, natural fibers, any derivative thereof, any polymer blend thereof, any copolymer thereof or any combination thereof. In addition, the first polymer resin 22 can be selected from biodegradable thermoplastics derived from natural resources, such as polylactic acid, poly-3-hydroxybutyrate, polyhydroxyalkanoates, or any blend, copolymer, polymer solutions or combination thereof. Those skilled in the chemical arts may know of other polymers that can also be used to form the hybrid non-woven web 12. It should be understood that the hybrid non-woven 12 of this invention is not limited to just those polymers identified above.

Still referring to FIG. 1, a second polymer resin 44, in the form of small solid pellets, granules or powder, is placed into a hopper 46 and is then routed through a conduit 48 to an extruder 50. In the extruder 50, the second polymer resin 44 is heated to an elevated temperature. The temperature will vary depending on the composition and melt temperature of a particular polymer. Usually, the second polymer resin 44 is heated to a temperature at or above its melting temperature. The melted, second polymer resin 44 is transformed into a molten material (polymer) which is then routed through a conduit 52 to a die block 54 having a spinnerette body 56 secured thereto. The die block 54 contains a plurality of nozzles 58 through which the molten material is extruder into filaments 60. The filaments 60 are contacted by gas (air) jets (not shown) which draw the filaments 60 into second spun-blown® fibers 62. Each of the fibers 62 has an average diameter of less than about 10 microns. Desirably, each of the fibers 62 has an average diameter ranging from between about 1 micron to about 10 microns. More desirably, each of the fibers 62 has an average diameter ranging from between about 1 micron to about 9 microns.

The Spinnerette 56 also includes a pair of cover strips 64, 64 which function to shelter the plurality of nozzles 58 from the entrained air in the room that may be drawn in from the sides and which could have a cooling effect on the extruded filaments 60, 60.

The second polymer resin 44 can be identical to the first polymer resin 22 or be different from the first polymer resin 22. The compositions of the first and second polymer resins, 22 and 44 respectively, will depend on the final hybrid non-woven web 12 one wishes to produce. Likewise, the characteristics, such as diameter, tensile strength, etc. of the first spun-blown® fibers 40 can be identical to the characteristics of the second spun-blown® fibers 62 or be different therefrom. Generally, when the first and second polymer resins, 22 and 44 respectively, are the same, the first and second spun-blown® fibers, 40 and 62 respectively, will have the same diameter and strength. However, the first and second spun-blown® fibers, 40 and 62 could have different characteristics, such as diameter, strength, etc. if desired. The characteristics of the first and second spun-blown® fibers 40 and 62 can be changed if the spinnerette bodies 34 and 56, and the nozzles 36 and 58 have different physical dimensions, configurations and/or design. For some hybrid non-woven webs 12, one may want the first and second spun-blown® fibers, 40 and 62 respectively, to be identical, while in other applications, they can be different.

Still referring to FIG. 1, a stream of the fibers of the first material 14 is comingled between the streams of the first and second spun-blown® fibers, 40 and 62 respectively. A majority of the fibers of the first material 14 will be positioned or sandwiched between the first and second spun-blown® fibers, 40 and 62 respectively, present in the first and second spun-blown® streams. In other words, a higher concentration of the fibers of the first material will be present in the middle portion of the finished, hybrid non-woven web 12. The ratio of the fibers of the first material 14 to the ratio of the first and second spun-blown® fibers, 40 and 62 respectively, can vary.

It should be understood that the denier of the fibers of the first material 14, for example, absorbent staple/pulp fibers, can be greater than the denier of either the first or second spun-blown® fibers, 40 and 62 respectively. By "denier" it is meant a unit of fineness for rayon, nylon and silk, based on a standard mass per length of 1 gram per 9,000 meters of yarn.

The first spun-blown® fibers 40 are formed from the first polymer resin 22 and the second spun-blown® fibers 62 are formed from the second polymer resin 44. The first polymer resin 22 can be identical to or be different from the second polymer resin 44. Each of the separate streams of the first and second spun-blown® fibers, 40 and 62 respectively, will join, merge or intersect with the steam of fibers of the first material 14.

The die blocks 32 and 54 are inclined at an angle theta Θ to the nozzle 20. This means that the separate streams of the first and second polymer fibers, 40 and 62, will contact the stream of the fibers of the first material 14 at an angle of inclination theta Θ. The angle of inclination theta Θ can range from between about 10° to about 75'. Desirably, the angle of inclination theta Θ can range from between about 30° to about 70°. More desirably, the angle of inclination theta Θ can range from between about 40° to about 65°. Even more desirably, the angle of inclination theta Θ can range from between about 45° to about 65°.

Besides the first material 14, the hybrid non-woven web 12 can include a homopolymer. By "homopolymer" it is meant a polymer consisting of identical monomer units. The hybrid non-woven web 12 can also be formed from various polyolefins, such as polypropylene. Alternatively, the hybrid non-woven web 12 can be formed from two or more polymers. The hybrid non-woven web 12 can contain bicomponent fibers wherein the fibers have a sheath-core configuration with the core formed from one polymer and the surrounding sheath formed from a second polymer. Still another option is to produce the hybrid non-woven web 12 from bicomponent fibers where the fibers have a side-by-side configuration. Those skilled in the polymer arts will be aware of various fiber designs incorporating two or more polymers.

The non-woven web 12 can include an additive which can be applied before or after the fibers are collected. Such additives can include, but are not limited to: a superabsorbent, absorbent particulates, polymers, nano-particles, abrasive particulates, activated carbon, active particles, active compounds, ion exchange resins, zeolites, softening agents, plasticizers, ceramic particle pigments, dyes, flavorants, aromas, controlled release vesicles, binders, adhesives, tackifiers, surface modification agents, lubricating agents, emulsifiers, vitamins, peroxides, antimicrobials, deodorizers, flame retardants, anti-foaming agents, anti-static agents, biocides, antifungals, degradation agents, stabilizing agents, conductivity modifying agents, or any combination thereof.

Referring again to FIG. 1, the method 10 further includes depositing the comingled streams of fibers of the first material 14 and the first and second spun-blown® fibers, 40 and 62 respectively, onto a forming wire 66. The forming wire 66 can be constructed as a closed loop which travels around a plurality of rollers 68. Four spaced apart rollers 68, 68, 68 and 68 are shown in FIG. 1. One of the rollers 68 can be a drive roller which causes the forming wire 66 to move or rotate in a desired direction. In FIG. 1, the forming wire 66 is moving in a clockwise direction, see the arrows. The forming wire 66 has a foraminous surface 70 which contains a plurality of very small openings (not shown). The foraminous surface 70 allows some of the fibers of the first material 14, as well as some of the second spun-blown) fibers 62 to be drawn through the openings of the foraminous surface 70. Various kinds and types of forming wires 66 are commercially available today. Albany International Co. of Albany, N.Y. manufactures and sell a variety of such forming wires 66. Those skilled in the art of forming webs are knowledgeable about the various kinds and types of forming wires 66.

A vacuum source 72 is located beneath the forming wire 66. The vacuum source 72 can vary in design and construction. For example, the vacuum source 72 can be a vacuum box that is positioned directly below the point of contact of the comingling streams or be located slightly downstream from this point. The vacuum source 72 exerts a force on the various fibers of the first material 14 and the first and second spun-blown® fibers, 40 and 62 respectively, and supports the hybrid non-woven web 12. The three streams will accumulate and the fibers forming the hybrid non-woven web 12 will solidify and be advanced in the direction the forming wire 66 is moving. The hybrid non-woven web 12 can then be wound up onto a wind-up spindle 74. At a predetermined length, the hybrid non-woven web 12 can be severed or cut by a cutter 76. Various types of web cutter 76 are commercially available and are well known to those skilled in the art.

The hybrid non-woven web 12 formed by the above method will include a matrix of fibers of a first material 14 and first and second spun-blown® fibers, 40 and 62 respectively. The first and second spun-blown® fibers, 40 and 62 respectively, are formed from a thermoplastic composition that contains at least one polymer having a melt flow rate of from between about 5 grams/10 minutes to about 6,000 grams/10 minutes at 230° C. The melt flow rate (MFR) is the weight of a polymer (in grams) forced through an extrusion rheometer orifice (0.0825 inch diameter) when subjected to a load of 2160 grams in 10 minutes at 230° C. Unless otherwise indicated, the melt flow rate was measured with ASTM test Method 1238.

Desirably, the first and second spun-blown® fibers, 40 and 62 respectively, are formed from a thermoplastic composition that contains at least one polymer having a melt flow rate ranging from between about 5 grams/10 minutes to about 5,000 grams/10 minutes at 230° C. More desirably, the first and second spun-blown® fibers, 40 and 62 respectively, are formed from a thermoplastic composition that contains at least one polymer having a melt flow rate ranging from between about 5 grams/10 minutes to about 500 grams/10 minutes at 230° C. Even more desirably, the first and second spun-blown® fibers, 40 and 62 respectively, are formed from a thermoplastic composition that contains at least one polymer having a melt flow rate ranging from between about 5 grams/10 minutes to about 150 grams/10 minutes at 230° C.

The first and second spun-blown® fibers, 40 and 62 respectively, have an average diameter of between about 1 microns to 10 microns. Desirably, the first and second spun-blown® fibers, 40 and 62 respectively, have an average diameter of less than about 10 microns. More desirably, the first and second spun-blown® fibers, 40 and 62 respectively, have an average diameter of less than about 9 microns.

The first and second spun-blown® fibers, 40 and 62 respectively, further have a standard deviation ranging from between about 0.9 microns to about 5 microns. Desirably, the first and second spun-blown® fibers, 40 and 62 respectively, have a standard deviation ranging from between about 0.9 microns to about 4 microns. More desirably, the first and second spun-blown® fibers, 40 and 62 respectively, have a standard deviation ranging from between about 0.9 microns to about 3 microns.

The hybrid non-woven web 12 will have a tensile strength of at least about 7 gf/gsm/cm width, measured in a machine direction. Desirably, the hybrid non-woven web 12 will have a tensile strength of at least about 6 gf/gsm/cm width, measured in a machine direction. More desirably, hybrid non-woven web 12 will have a tensile strength of at least about 5 gf/gsm/cm width, measured in a machine direction. Even more desirably, hybrid non-woven web 12 will have a tensile strength of at least about 3.5 gf/gsm/cm width, measured in a machine direction.

In addition, the hybrid non-woven web 12 will have a tensile strength of at least about 3 gf/gsm/cm width, measured in a cross direction (perpendicular to the machine direction). Desirably, the hybrid non-woven web 12 will have a tensile strength of at least about 2 gf/gsm/cm width, measured in a cross direction. More desirably, the hybrid non-woven web 12 will have a tensile strength of at least about 1 gf/gsm/cm width, measured in a cross direction.

The hybrid non-woven web 12 will further have a basis weight ranging from between about 20 gsm to about 500 gsm. Desirably, the hybrid non-woven web 12 will have a basis weight ranging from between about 20 gsm to about 400 gsm. More desirably, the hybrid non-woven web 12 will have a basis weight ranging from between about 20 gsm to about 300 gsm.

The first material 14 of the hybrid non-woven web 12 will make-up from between about 5% to about 95%, by weight, of the hybrid non-woven web 12. Desirably, the first material 14 of the hybrid non-woven web 12 will make-up from between about 10% to about 90%, by weight, of the hybrid non-woven web 12. More desirably, the first material 14 of the hybrid non-woven web 12 will make-up from between about 15% to about 85%, by weight, of the hybrid nonwoven web 12. Even more desirably, the first material 14 of the hybrid non-woven web 12 will make-up from between about 20% to about 80%, by weight, of the hybrid non-woven web 12.

The first material 14 of the hybrid non-woven web 12 can be a dry-laid stream formed from staple/pulp fibers. Desirably, the first material 14 of the hybrid non-woven web 12 is a dry-laid stream formed from absorbent, staple/pulp fibers. Alternatively, the first material 14 of the hybrid non-woven web 12 can be a dry-laid stream formed from non-absorbent, staple/pulp fibers. Absorbent fibers are preferred over non-absorbent fibers.

Figure 2:
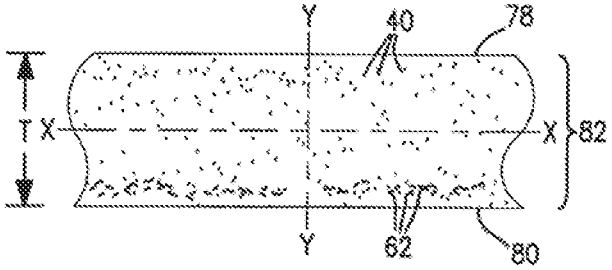
FIG. 2 is an enlarged, vertical cross-section of the hybrid non-woven web shown in FIG. 1 exhibiting a higher concentration of the first and second spun-blown® fibers located adjacent to the top and bottom surfaces of the hybrid non-woven web.

Referring now to FIG. 2, an enlarged, vertical cross-section of the hybrid non-woven web 12 is depicted. The hybrid non-woven web 12 has a top surface 78 and a bottom surface 80. Optionally, the top surface 78 can be formed from spunmelt fibers having an average pore size of at least about 15 microns so that it is abrasive. The bottom surface 80 is the surface that contacts the forming wire 66. The bottom surface 80 could also be formed from spunmelt fibers having an average pore size of at least about 15 microns so that it is abrasive.

The hybrid non-woven web 12 has a longitudinal central axis X-X that is aligned parallel to the machine direction, and a vertical central axis Y-Y, that is aligned 90 degrees to the machine direction. The hybrid non-woven web 12 exhibits a higher concentration of the first and second spun-blown® fibers, 40 and 62 respectively, located adjacent to the top and bottom surfaces, 78 and 80 respectively. Located between the top and bottom surfaces, 78 and 80 respectively, is a middle portion 82. The middle portion 82 exhibits a gradient structure wherein fibers of the first material 14 and the first and second spun-blown® fibers 40 and 62 are present. In the upper half of the hybrid non-woven web 12 (located above the X-X axis), a greater quantity of the first spun-blown® fibers 40 are comingled with the fibers of the first material 14, while in the lower half of the hybrid non-woven web 12 (located below the X-X axis), a greater quantity of the second spun-blown® fibers 62 are comingled with the fibers of the first material 14. It should be noted that some of the first spun-blown® fibers 40 may be present in the lower half of the hybrid non-woven web 12 and some of the second spun-blown® fibers 62 may be present in the upper half of the hybrid non-woven web 12.

Still referring to FIG. 2, the hybrid non-woven web 12 has a thickness t. The thickness t is the distance measured between the top surface 78 and the bottom surface 80. The gradient structure across this thickness t can vary. By "gradient" it is meant a rate of inclination; a slope. By "gradient structure" it is meant the different amount of the various fibers (the fibers of the first material 14, the first spun-blown® fibers 40, and the second spun-blown® fibers 62) located across the hybrid non-woven web 12. Likewise, the gradient in the middle portion 82 of the hybrid non-woven web 12 can also vary. One can vary the gradient structure several ways when forming the hybrid non-woven web 12. The gradient structure can be varied by controlling various parameters, such as but not limited to: by controlling the amount of fibers of the first material 14 being introduced, by controlling the amount of the first spun-blown® fibers 40 being introduced, and/or by controlling the amount of the second spun-blown® fibers 62 being introduced. In addition, the angle of inclination, theta Θ, at which the two streams of the first and second spun-blown® fibers, 40 and 62 respectively, are comingled with the fibers of the first material 14 can be changed. One can also change the arrangements of the nozzles 36 and 58 which will alter the number and position of the filaments 38 and 60 exiting therefrom. In the hybrid non-woven web 12, the concentration of either the first or second spun-blown® fibers, 40 or 62 respectively, located adjacent to each of the top and bottom surfaces, 78 and 80 respectively, can range from between about 10% to about 100%, by weight, and the concentration of either of the first or second spun-blown® fibers, 40 or 62 respectively, in the middle portion 82 can be less than about 90%, by weight. Desirably, the concentration of either of the first or second spun-blown® fibers, 40 or 62, located adjacent to each of the top and bottom surfaces ranges from between about 20% to about 80%, by weight, and the concentration of either of the first or second spun-blown® fibers in the middle portion is less than about 75%, by weight. More desirably, the concentration of either of the first or second spun-blown® fibers, 40 or 62, located adjacent to each of the top and bottom surfaces ranges from between about 10% to about 100%, by weight, and the concentration of either of the first or second spun-blown® fibers in the middle portion is less than about 60%, by weight. Even more desirably, the concentration of either of the first or second spun-blown fibers, 40 or 62, located adjacent to each of the top and bottom surfaces ranges from between about 30% to about 95%, by weight, and the concentration of either of the first or second spun-blown® fibers, 40 or 62, in the middle portion is less than about 50%, by weight.

The hybrid non-woven web 12 further has a mean pore size distribution of at least about 20 microns. Desirably, the hybrid non-woven web 12 has a mean pore size distribution of at least about 26 microns. More desirably, the hybrid non-woven web 12 has a mean pore size distribution of at least about 29 microns.

The hybrid non-woven web 12 can also be formed from high molecular weight polymers that possess a high melt viscosity. Various high molecular weight polymers having a high melt viscosity are well known to those skilled in the art.

Figure 3:
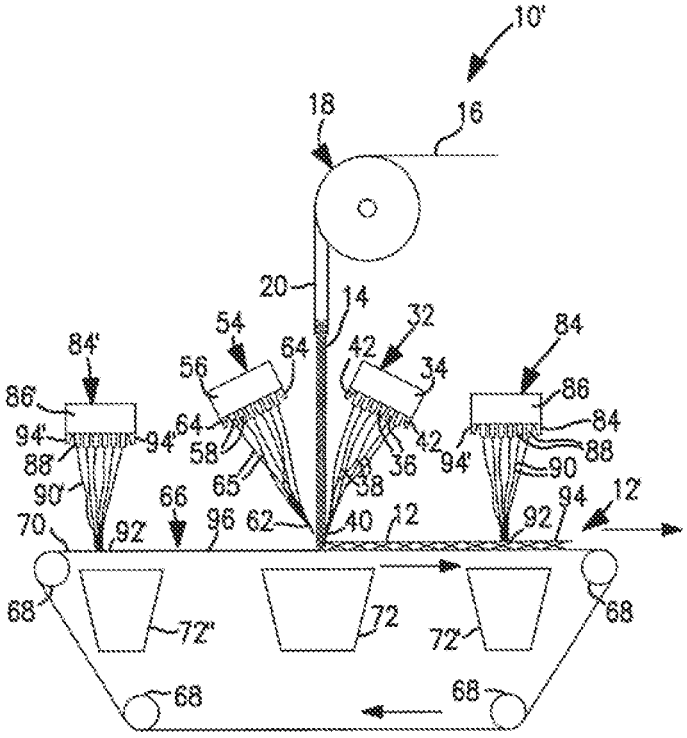
FIG. 3 is a schematic of an alternative method for forming a hybrid non-woven web which includes adding two additional spunmelt layers to form a thicker and stronger web.

Referring to FIG. 3, an alternative method 10' is depicted for forming a hybrid non-woven web 12'. The method 10' is similar to that shown in FIG. 1 and identical components are referred to by identical numbers as were used in FIG. 1. The method 10' includes the addition of first and second die blocks, 84 and 84' respectively, located on either side of the fiberizer 18 and the two die blocks 32 and 54. Each die block 84 and 84' has a spinnerette body, 86 and 86' respectively and a plurality of nozzles, 88 and 88' respectively. Filaments 90 and 90' are extruded from nozzles, 88 and 88' respectively. The filaments, 90 and 90' respectively, will form first and second spunmelt fibers, 92 and 92' respectively. The spunmelt fibers 92 form a first exterior layer 94 and the spunmelt fibers 92' form a second exterior layer 96. The first exterior layer 94 and the second exterior layer 96 sandwich the hybrid non-woven web 12 there between and forms a thicker hybrid non-woven web 12'. Each of the first and second exterior layers 94 and 96 respectively, contains larger and stiffer fibers with high abrasion resistance and high tensile properties. This produces a hybrid non-woven web 12' with different characteristics from the hybrid non-woven web 12 shown in FIG. 1.

Two additional vacuum sources 72' and 72" are also utilized. The vacuum source 72' is positioned below the stream of spunmelt fibers 92 and the other vacuum source 72" is positioned below the stream of spunmelt fibers 92'. Each of the two additional vacuum sources 72' and 72" operate in the same way as the vacuum source 72.

Figure 4:
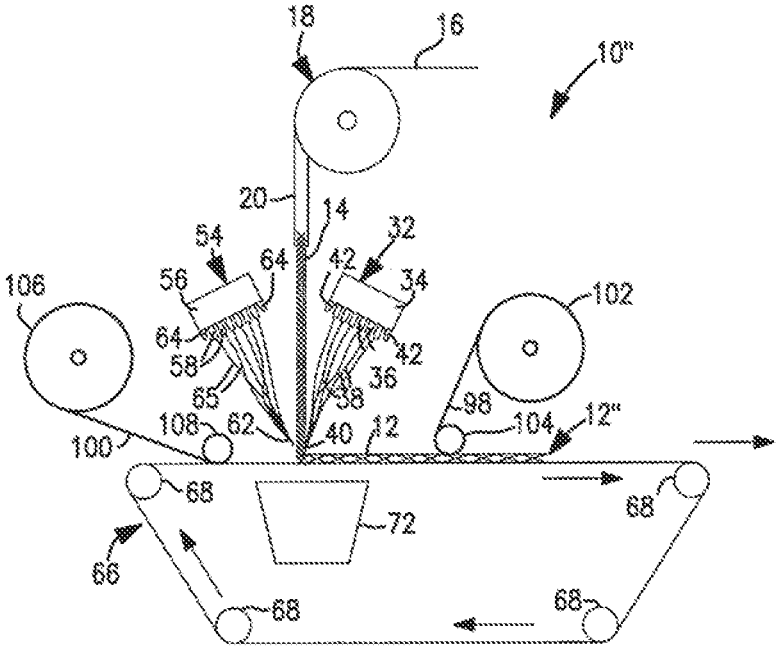
FIG. 4 is a schematic of a third method for forming a hybrid non-woven web which includes sandwiching the hybrid non-woven web between two scrim layers.

Referring to FIG. 4, a third method 10" is depicted for forming a hybrid non-woven web 12". The method 10" is similar to that shown in FIG. 1 and identical components are referred to by identical numbers as were used in FIG. 1. The method 10" includes the addition of first and second scrim layers, 98 and 100 respectively. Each of the first and second scrim layers 98 and 100 respectively, is made of spunmelt. The hybrid non-woven web 12 is sandwiched between the first and second scrim layers 98 and 100. The first scrim layer 98 is positioned on top of the hybrid non-woven web 12 and the second scrim layer 100 is positioned below the hybrid non-woven web 12 to form a new hybrid non-woven web 12". The basis weight of each of the first and second scrim layers, 98 and 100 respectively, ranges from between about 5 grams per square meter (gsm) to about 50 gsm. The first and second scrim layers, 98 and 100 respectively, function to increase the abrasion resistance and increase the tensile strength of the hybrid non-woven web 12".

The first scrim layer 98 is withdrawn from a supply roll 102 and is advanced around a roller 104 which urges it into contact with the hybrid non-woven web 12. Likewise, the second scrim layer 100 is withdrawn from a supply roll 106 and is advanced around a roller 108 which urges it into contact with the forming wire 66.

Figure 5:
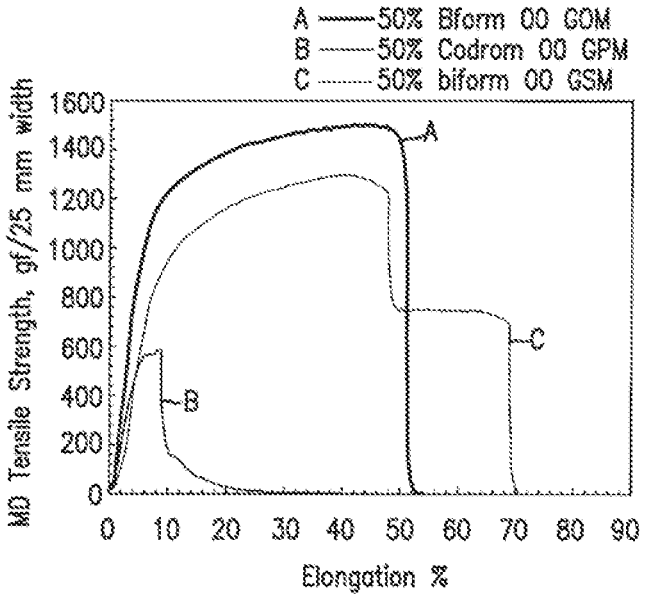
FIG. 5 is a chart showing the machine direction tensile strength of a Coform sample and two Bi-form® samples.

Referring to FIG. 5, a chart is shown which compares the machine direction tensile strength of a Coform sample (B) and two Bi-form® samples (A and C). The Coform sample (B) is 50% Coform having a basis weight of 60 gsm. The two Bi-form® samples (A and C) are each 50% with a basis weight of 60 gsm but each has a different gradient structure. The chart shows that the Bi-form® samples (A and C) are three times stronger than the Coform sample.

Figure 6:
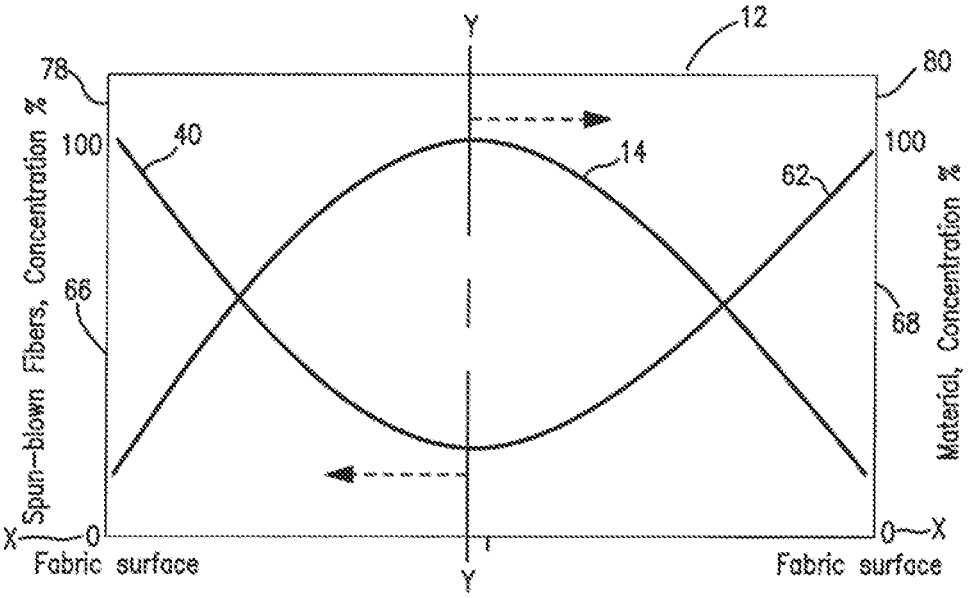
FIG. 6 is a chart showing the gradient structure in a non-woven web.

Referring to FIG. 6, a gradient structure for a hybrid non-woven web 12 is shown. On the top and bottom surfaces, 78 and 80 respectively, the spun-blown® fibers concentration can range from between about 10% to about 100% by weight, while the concentration of the fibers of the first material 14 can have a concentration that ranges from between about 0% to about 90% by weight. At the centerline of the cross-section Y-Y of the hybrid non-woven web 12, the spun-blown® fibers concentration can vary from between about 0% to about 60% by weight, while the fibers of the first material 14 can vary from between about 10% to about 100%.

The present invention teaches a hybrid non-woven web 12 and an apparatus and a method for forming such. The apparatus and process bridges the gap between a conventional meltblown process and a conventional spunbond process. The present invention utilizes a multi-row Spinnerette similar to the Spinnerette used in spunbond except the nozzles and stationary pins are arranged in a unique fashion to allow parallel gas jets to surround the spun filaments in order to attenuate and solidify them. In addition, each of the extruded filaments is shrouded by pressurized gas and it's temperature can be from between about 0° C. to about 250° C. colder or hotter than typical polymer melt temperatures. Furthermore, the periphery around all of the filaments is surrounded by a curtain of pressurized gas, essentially a dual shroud system. Such an apparatus and method is taught in U.S. Ser. No. 14/271,638; U.S. Ser. No. 14/271,675 and U.S. Ser. No. 14/271,655, all of which are incorporated by reference and made a part hereof.

The apparatus for forming the hybrid non-woven web 12 mentioned above will include a fiberizer 18 for forming a plurality of fibers of a first material 14. The apparatus also includes a first extruder 28 and a second extruder 50. The first extruder 28 will convey molten material to a first die block 32 which is capable of forming a plurality of first spun-blown® fibers 40. The second extruder 50 will convey molten material to a second die block 54 which is capable of forming a plurality of second spun-blown® fibers 62. The first and second die blocks, 32 and 54 respectively, are aligned at an angle Θ relative to the fiberizer 18 and are positioned on opposite sides of the stream of fibers of the first material 14, see FIG. 1. The angle of inclination theta Θ causes the first and second spun-blown® fibers, 40 and 62 respectively, to merge and be comingled with the fibers of the first material 14 and form a hybrid non-woven web 12.

The apparatus further includes a movable forming wire 66 which receives the comingled fibers, 14, 40 and 62, and conveys the fibers which form the hybrid non-woven web 12 in a desired direction. The hybrid non-woven web 12 is advanced toward a wind-up spindle 74 onto which the hybrid non-woven web 12 is collected once it exits the forming wire 66. Optionally, the apparatus can further include a cutter 76 which can sever the hybrid non-woven web 12 into a predetermined length.

The method described above is capable of spinning first and second spun-blown® fibers into fibers having a diameter similar to the diameter of meltblown fibers, between 1-10 microns, but each having a strength equivalent to those of spunbond fibers, which have a diameter in the range of 15-50 microns. The spun-blown® process can accomplish this by operating at high pressures, up to 2,000 pounds per square inch (psi). This use of high pressure allows one to spin high molecular weight polymers which have a high melt viscosity. Many of the prior art processes which comingle meltblown fibers with a staple material require a large quantity of the meltblown fibers in order to provide adequate strength to the finished web. Our hybrid non-woven web 12 is different in that lesser amounts of the first and second spun-blown® fibers, 40 and 62 respectively, are needed to form a hybrid non-woven web 12 having the required integrity because our spun-blown® fibers 40 and 62 are so much stronger.

EXPERIMENTS

1. Inventive Non-woven Web

The following non-woven samples were produced using a pilot line that had two 25" dies with multi-row Spinnerettes secured thereto, manufactured by Biax-Fiberfilm Corporation having an office at N1001 Tower View Drive, Greenville, Wis. 54942-8635. Each Spinnerette had a total of 4,150 nozzles and each nozzle had an inside diameter of 0.305 mm. Each nozzle was surrounded by a first enlarged opening 80 formed in the exterior member 78 where pressurized gas (air) was allowed to exit. The inside diameter of each of the first enlarged openings 80 was 1.4 mm. By comparison, a typical commercial Spinnerette, manufactured by Biax-Fiberfilm Corporation, can have from between about 6,000 to about 12,000 nozzles per meter. Conventional meltblown material 22 (polymer) was obtained from different vendors and the processing condition and system parameters are disclosed in Table 1.

TABLE 1

| Sample | Polymer | Basis Weight (gsm) | Die Technology | Polymer Melt Temp. ° C. | Gas Temp ° C. | Gas pressure (bar) | DCD (cm) | Polymer Throughput g/hole/min | Nozzle inside diameter (mm) | Pulp % |
|---|---|---|---|---|---|---|---|---|---|---|
| S-1 | Metocene MF650W | 54.25 | Biax-New Design | 225 | 175 | 0.6 | 50 | 0.12 | 0.308 | 50 |
| S-2 | Achieve 6936G1 | 55.55 | Conventional MB die | | | | | | | 50 |
| S-3 | Metocene MF650W | 60.25 | Biax-New Design | 225 | 175 | 0.6 | 50 | 0.12 | 0.308 | 60 |
| S-4 | Achieve 6936G1 | 66.5 | Conventional MB die | | | | | | | 75 |
| S-5 | PLA 6202D | 45 | Biax-New Design | 260 | 304 | 0.55 | 45 | 0.12 | 0.308 | 55 |
| S-6 | PLA 6202D | 125 | Biax-New Design | 260 | 304 | 0.55 | 45 | 0.12 | 0.308 | 55 |

2. Process Conditions

Several nonwovens webs were made using the above described pilot line. Three different kinds of polymer resins were used. The first polymer resin was ExxonMobil polypropylene (PP) resin marketed under the trade name Achieve 6936G1. ExxonMobil Chemical has an office at 13501 Katy Freeway, Houston, Tex. 77079-1398. Achieve 6936G1 has a melt flow rate of 1,550 grams/10 minute (g/10 min.), according to American Standard Testing Method (ASTM) D 1238, at 210° C. and 2.16 kilograms (kg). The second polymer resin was Metocene MF650W marketed by LyondellBasell. LyondellBasell has an office at LyondellBasell Tower, Suite 700, 1221 McKinney Street, Houston, Tex. 77010. Metocene MF650W has a melt flow rate of 500 g/10 min. according to ASTM D 1238, at 210° C. and 2.16 kg. The process conditions of the different samples are disclosed in Table 1. The third resin was Polylactic acid (PLA) from NatureWorks, LLC marketed under the trade name Ingeo biopolymer 6202D. NatureWorks, LLC is based in at 15305 Minnetonka Boulevard, Minnetonka, Minn. 55345-USA. The pulp used was purchased from the Georgia Pacific Company that is being sold under the trade name GP 4826 fully treated fibers, although other defibrillated types of pulps can be used. Georgia-Pacific LLC is an American pulp and paper company based in 133 Peachtree St NE, Atlanta, Ga. 30303.

Operating conditions for processing the used thermoplastic resins are disclosed in Table 1 besides pulp used percentage to fabricate the hybrid nonwoven mats. Pulp sheet was being fiberized using a hammer mill running at 1100 RPM at 94.2° F. and 90-95% relative humidity to produce 69 Kg/hr of fluff pulp fibers. Afterwards, these pulp fibers are conveyed using high speed air through a duct and comingled with the two streams of the spun-blown® fibers.

3. Characterization Methods 3.1 Basis Weight

Basis weight is defined as the mass per unit area and can be measured in grams per meter squared (g/m$^2$) or ounces per square yard (osy). A basis weight test was performed according the INDA standard IST 130.1 which is equivalent to the ASTM standard ASTM D3776. INDA is an abbreviation for: "Association of the Non-Woven Fabrics Industry". Ten (10) different samples were die-cut from different locations in the non-woven web and each sample had an individual area equal to 100 square centimeters (cm$^2$). The weight of each sample was measured using a sensitive balance within ±0.1% of weight on the balance. The basis weight, in grams/meter$^2$ (g/m$^2$) was measured by multiplying the average weight by a hundred (100).

3.2 Fiber Diameter Measurements

To examine the fiber morphology and the fiber diameter distribution of the manufactured nonwoven webs, samples were sputter coated with a 10 nanometer (nm) thin layer of gold and analyzed with a scanning electron microscope, model SEM, Phenom G2, manufactured by Phenom World BV having an office at Dillenburgstraat 9E, 9652 AM Eindhoven, The Netherlands. Images were taken at 500× and 1,500× magnification under 5 kilovolts (kV) of an accelerating voltage for the electron beams. Fiber diameters were measured using Image J software. "Image J" is a public domain, Java-based image processing program developed at the National Institute of Health and can be downloaded from http://imagej.nih.gov/ij/. For each sample, at least 100 individual fiber diameters were measured.

3.3 Fabric Tensile Strength

The breaking force is defined as the maximum force applied to a nonwoven web carried to failure or rupture. For ductile material like nonwoven webs, they experience a maximum force before rupturing. The tensile strength was measured according to the ASTM standard D 5035-90 which is the same as INDA Standard IST 110.4 (95). To measure the strength of the non-woven web, six (6) specimen strips from each non-woven web were cutout at different locations across the non-woven web and each one had a dimension of 25.4 millimeters (mm)×152.4 mm (1" by 6"). Each strip was clamped between the jaws of the tensile testing machine which was a Thwing Albert Tensile Tester. The clamps pulled the strip at a constant rate of extension of 10 inch/minute. The average breaking force and the average extension percentage at the breaking force was recorded for each non-woven web in the form of gram force per basis weight per width of non-woven web (gf/gsm/cm).

3.4 Water Absorption Capacity

Water absorption capacity is defined at the amount of water absorbed per unit weight of dry absorbent material. Water absorption capacity measured according to the teaching of the INDA Standard Test IST 10.1(95) (for larger test specimens). In this test method, three (3) plies of 200×200 mm specimens were cut for each nonwoven samples and their weight was recorded. The weight of an empty wire screen was recorded. The dry plies were then placed in the wire screen and immersed in water for 1 minute after the specimen was completely wet. The screen was then raised and left for 10 minutes for draining and the difference in weight was recorded. The same procedure was repeated for three (3) replicates from three (3) different locations and the average amount of water absorbed per unit mass of dry nonwoven was reported.

3.5 Oil Absorption Capacity

Oil absorption capacity is defined at the amount of water absorbed per unit weight of dry absorbent material. Oil absorption capacity measured according to a similar way to the water absorption capacity according to INDA Standard Test IST 10.1(95) (for larger test specimens). In this test method, three (3) plies of 200×200 mm specimens were cut for each nonwoven samples and their weight was recorded. The weight of an empty wire screen was then recorded. The dry plies were placed in the screen and immersed in oil for 1 minute after the specimen was completely filled with oil. The screen was then raised and left for 10 minutes for draining and the difference in weight was recorded. The same procedure is repeated for three (30 replicates from three (3) different locations across the web and the average amount of water absorbed per unit mass of dry nonwoven was reported.

3.6 Pore Size

Pore size of samples have been measured using the capillary flow porometry from Porous Materials Inc. (PMI, Ithaca, N.Y.). The PMI porometry is based on the displacement of a wetting liquid, such as Silwick, from a pore by a gas. The work done by the gas equals the interfacial increase in the free energy. Our samples tested with the Silwick wetting liquid had a surface tension of 20.1 dynes/cm. It was assumed that Silwick completely wetted out the samples that were tested and hence a contact angle of 0° was taken for calculations of pore diameter using the Young-Laplace equation.

Example 1: Comparison Between Coform and Bi-form® with the Same Pulp Percentage

Figure 7:
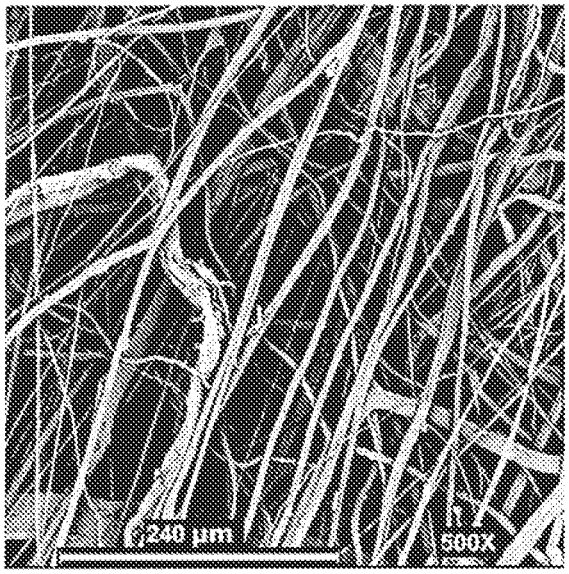
FIG. 7 is an image of a sample showing a Bi-form® surface taken with a Scanning Electron Microscope.
Figure 8:
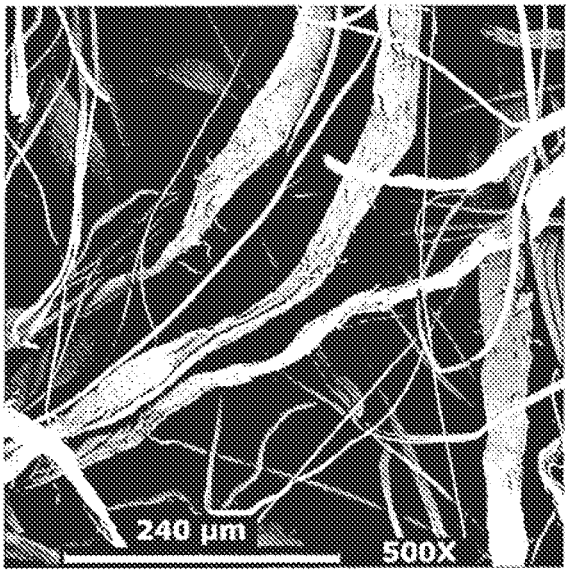
FIG. 8 is an image of a sample showing a Bi-form® core (middle portion) taken with a Scanning Electron Microscope.
Figure 9:
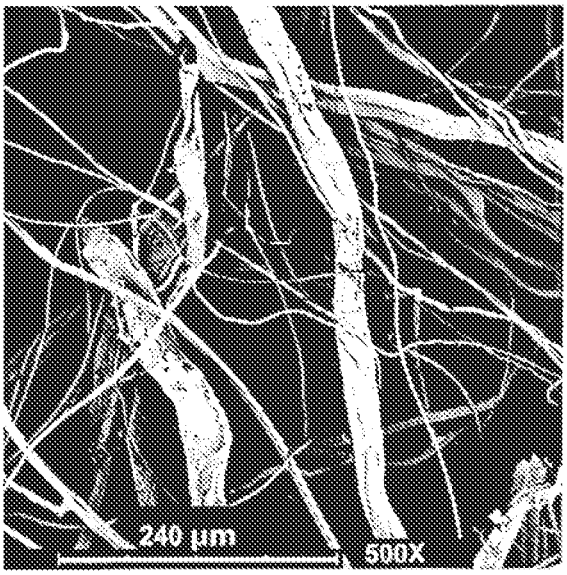
FIG. 9 is an image of a sample of a Coform surface taken with a Scanning Electron Microscope.

In the first example we formed a hybrid structure with strong spun-blown® fibers with pulp and compared its performance to similar hybrid structures that were made using a conventional meltblown process. Both structures have the same basis weight and the same pulp percentage. As shown in Table 2, the Bi-form® structure that was made with spunblown fibers shows three (3) times the machine direction (MD) tensile strength of a similar structure known as coform that was made with conventional meltblown fibers. The fiber size of the thermoplastic spun fibers was very close but the standard deviation for the spun-blown® fiber was higher because of the multi-row nature of the Spinnerette and the quench gradient that was happening between the row nozzles. The Bi-form® structure that was made with spun-blown® fibers exhibited high water and oil absorbency capacities over the hybrid non-woven structure that was made with conventional meltblown fibers. We believe that the broader fiber diameter distribution of the spun-blown® fabrics create more porosity, and therefore, higher water and oil contents can be absorbed within the structure than the one that was made with conventional meltblown fibers that has more narrow fiber diameter distribution. Another important feature of the hybrid non-woven structure that was made with spun-blown® fibers and pulp fibers is the concentration gradient across the web thickness. This interesting feature over a conventional coform structure can be easily seen by looking at the SEM images in FIGS. 7-9. As shown in FIG. 7, the SEM image of sample S-1 shows mostly thermoplastic spun-blown® fibers with almost no appearance of the pulp fibers on the surface. In FIG. 8, the SEM image, for the same sample, but for its core or middle portion, shows a much higher pulp concentration. In FIG. 9, the SEM image shows a blend of thermoplastic fibers and pulp fibers. The surface of sample S-1 tends to be softer than sample S-2 because of this feature. This semi-tri-laminate feature for the comingled fibers can also be proven by looking at the tensile curve behavior of such samples as shown in FIG. 5. Some of the Bi-form® replicates show two sudden failures which refer to the two surfaces that have higher thermoplastic concentration. The average pore size for S-1 was 20 μm in the case of a calendared web, 26 μm in the case of appoint bonded web, and 29 in the case of a pre-wetted web. The Average pore size of S-2 was 32 μm.

TABLE 2

| Sample | Fiber Size, μm | Standard Deviation, μm | Machine Direction Elongation Percent (%) | Machine direction Strength, gf/gsm/cm | Cross Direction Elongation Percent (%) | Cross Direction Strength, gf/gsm/cm | Water Absorption Capacity, g water/g Biform | Oil Absorption Capacity, g water/g Biform |
|---|---|---|---|---|---|---|---|---|
| S-1 | 4.84 | 3.84 | 49.03 | 11.3 | 87.79 | 4.56 | 8.96 | 10.31 |
| S-2 | 4.25 | 1.96 | 7.45 | 3.7 | 37.64 | 2.98 | 7.56 | 9.45 |

Example 2: Comparison Between Coform and Bi-form® with the Same Thermoplastic Fiber Percentage In this example, we were comparing two hybrid structures of thermoplastic fibers and pulp fibers. The two samples had the same amount thermoplastic fibers but the pulp concentration was different. Table 3 shows the different characteristics of the two webs. As shown, sample S-3 had lower pulp content, 40%-50% higher tensile properties, and very close water and oil absorption capacity, although sample S-4 had the same thermoplastic fibers content. We believe the enhancement in the absorption rate was due to the higher porosity and to the wide fiber diameter distribution while the higher strength is due to the higher strength of the spun-blown® fibers over conventional meltblown fibers.

TABLE 3

| Sample | Fiber Size, μm | Standard Deviation, μm | Machine Direction Elongation Percent (%) | Machine direction Strength, gf/gsm/cm | Cross Direction Elongation Percent (%) | Cross Direction Strength, gf/gsm/cm | Water Absorption Capacity, g water/g Biform | Oil Absorption Capacity, g water/g Biform |
|---|---|---|---|---|---|---|---|---|
| S-3 | 3.864 | 2.748 | 46.13167 | 7.86 | 100.54 | 3.28 | 9.37 | 11.06 |
| S-4 | 3.12 | 0.95 | 17.77833 | 4.39 | 53.73 | 1.47 | 8.25 | 12.04 |

Example 3: 100% Green Bio-based hybrid Nonwoven Mat

In a third example, we were making a 100% Green Bio-based non-woven mat based on 100% polymers made from renewable resources and pulp fibers. The non-woven mat herein comprises 45-50% polylactic acid which was made from renewable agriculture feedstock and pulp fibers, which was bio-based cellulosic fibers. Polylactic acid has high relative viscosity, 3.1 measured according to CD Internal Viscotek Method, and thus it requires high temperature and processing pressure in order to spin through capillaries. The spun-blown® process, is capable of operating at up to 2,000 psi of die pressure which enables spinning such a unique polymer into fine micro fibers at die pressures around 800 psi. Spinning polymers that have a high melt viscosity using conventional meltblown technology, for example, a single row of nozzle located between two inclined air jets, is quite difficult because meltblown equipment cannot operate at die pressures above 500 psi.

Two PLA-Pulp Bi-form) samples were made. One had 50% pulp with a basis weight of 45 g/m$^2$, while the second sample had 55% pulp with a basis weight of 125 g/m$^2$. As shown in Table 4, the PLA-Pulp Bi-form samples outperformed the PP-Plup Bi-form® sample in water absorption capacity for light basis weight web. The primary reason is that PLA fibers are hydrophilic by nature so they attract water naturally while PP fibers are hydrophobic by nature so reply water unless their surface chemistry is changed by using surfactants. Also, the normalized fabric strength is quite higher than coform samples that were made of PP-Pulp fibers using conventional single row meltblown technology.

Elongation percentages of the PLA-Pulp Bi-form® sample were close to those of a coform PP-Pulp mat but lower than the Bi-form® PP-Pulp mats. Such performance of PLA fibers is expected since they are more stiff and brittle than PP fibers.

TABLE 4

| Sample | Machine Direction Elongation (%) | Machine direction Strength, gf/gsm/cm | Cross Direction Elongation (%) | Cross Direction strength, gf/gsm/cm | Water Absorption Capacity g water/g Biform | Oil Absorption Capacity, g water/g Biform |
|---|---|---|---|---|---|---|
| S-5 | 17.1 | 9.2 | 57.68 | 2.1 | 11.99 | 10.57 |
| S-6 | NA | NA | NA | NA | 12.05 | 14.85 |

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A hybrid non-woven web comprising:

a fiber matrix defined by comingled fibers of multiple materials, including:

a first material defined by pulp fibers; and a second material defined by spun-blown fibers, wherein the spun-blown fibers:

are defined by a thermoplastic composition that contains at least one polymer having a melt flow rate of between about 5 grams/10 minutes to about 500 grams/10 minutes at 230° C.; and have an average fiber diameter (AFD) of between about 1 micron to 10 microns; and define a standard deviation of fiber diameter (SDFD) with a magnitude that is at least 50% of AFD.

2. The hybrid non-woven web of claim 1, wherein the web defines:

a web thickness defined between a pair of opposing web outer surfaces;

a core defined inwardly between the pair web outer surfaces; and a fiber gradient defined through the web thickness, wherein the fiber gradient provides a higher percentage of the first fibrous material at the core than at either of the pair of opposing web outer surfaces.

3. The hybrid non-woven web of claim 1, wherein the spun-blown fibers have smaller average fiber diameters than fiber diameters of the fibrous material so that the pair of opposing web outer surfaces is defined by a higher percentage of relatively smaller diameter spun-blown fibers.

4. The hybrid non-woven web of claim 1, wherein the magnitude of SDFD is at least 70% of AFD.

5. The hybrid non-woven web of claim 1, wherein the magnitude of SDFD is at least 75% of AFD.

6. The hybrid non-woven web of claim 5, wherein the non-woven web defines an average pore size of less than 30 microns.

7. A hybrid non-woven web comprising:

a fiber matrix having comingled fibers of multiple materials, including:

a first material; and at least a second material defined by first and second spun-blown fibers, each of the first and second spun-blown fibers being formed from a thermoplastic composition that contains:

at least one polymer having:

a melt flow rate of from between about 5 grams/10 minutes to about 6,000 grams/10 minutes at 230° C.;

an average fiber diameter of between about 1 micron to 10 microns; and a standard deviation of fiber diameter from between about 0.9 microns to about 5 microns; and wherein:

the hybrid non-woven web has a tensile strength of at least about 5 gf/gsm/cm width measured in a machine direction; and the non-woven web defines an average pore size of less than 30 microns.

8. The hybrid non-woven web of claim 7, wherein a ratio of standard deviation of fiber diameter to average fiber diameter is at least 1:2.

9. The hybrid non-woven web of claim 7, wherein a ratio of standard deviation of fiber diameter to average fiber diameter is at least 7:10.

* * * * *